US009458673B2

(12) United States Patent
Ching

(10) Patent No.: US 9,458,673 B2
(45) Date of Patent: Oct. 4, 2016

(54) HARD-ROCK CORE BARREL ROLLER CUTTER ASSEMBLY

(71) Applicant: Chung Jie Vinsing Ching, North Point (HK)

(72) Inventor: Chung Jie Vinsing Ching, North Point (HK)

( * ) Notice: Subject to any disclaimer, the term of this patent is extended or adjusted under 35 U.S.C. 154(b) by 0 days.

(21) Appl. No.: 14/386,001

(22) PCT Filed: Feb. 17, 2013

(86) PCT No.: PCT/CN2013/071621

§ 371 (c)(1),
(2) Date: Sep. 18, 2014

(87) PCT Pub. No.: WO2014/117416

PCT Pub. Date: Aug. 7, 2014

(65) Prior Publication Data

US 2015/0322723 A1 Nov. 12, 2015

(30) Foreign Application Priority Data

Jan. 31, 2013 (CN) ..... 2013 2 0057422 U

(51) Int. Cl.
*E21B 10/20* (2006.01)
*B28D 1/14* (2006.01)
*E21B 10/62* (2006.01)

(52) U.S. Cl.
CPC ..... *E21B 10/20* (2013.01); *B28D 1/14* (2013.01); *E21B 10/62* (2013.01)

(58) Field of Classification Search
CPC ..... E21B 10/20; E21B 10/62; E21C 35/18; E21C 35/19; E21C 2035/191; E21C 35/193; E21C 35/1936; B28D 1/14
See application file for complete search history.

(56) References Cited

U.S. PATENT DOCUMENTS 6,386,298 B1 * 5/2002 Smith ..... E21B 10/28 175/385
2012/0205160 A1 * 8/2012 Ricks ..... E21B 10/14 175/331

* cited by examiner

*Primary Examiner* — David Andrews
*Assistant Examiner* — Kristyn Hall
(74) *Attorney, Agent, or Firm* — George G. Wang; Bei & Ocean

(57) ABSTRACT

The present invention provides a hard-rock core barrel roller cutter assembly, which comprises a roller cutter and a saddle. The roller cutter comprises a base portion for operating, and a connecting portion integrated with the base portion and detachably connected to the saddle. The connecting portion has a butted oblique plane, and a width of the connecting portion is gradually increased from one end adjacent to the base portion to another end far away from the base portion. A fixing block is detachably connected to the saddle, and the fixing block has a pressure slope which matches with the butted oblique plane. A width of the fixing block is gradually decreased from one end adjacent to the base portion to another end far away from the base portion, and the saddle is muff-jointed out of the connecting portion and the fixing block. Comparing with the conventional technology, the roller cutter and the saddle of the present invention can be quickly assembled and detached, to improve the efficiency of the drilling operation. Simultaneously, the connecting strength thereof is high, and can satisfy the requirements of the drilling operation, and can be standardized.

1 Claim, 2 Drawing Sheets

HARD-ROCK CORE BARREL ROLLER CUTTER ASSEMBLY

TECHNICAL FIELD

The present invention relates to a hard-rock core barrel roller cutter assembly.

DESCRIPTION OF THE RELATED ART

Hard-rock core barrel roller cutters assembly is often used in foundation piling engineering operation, which comprises a roller cutter and a saddle. The roller cutter is an operation portion thereof, and configured for crushing stones when rotating, to achieve the purpose of drilling. While in operation, the roller cutter should be fixed on the saddle to connect with a power take-off apparatus. However, in the conventional technology, the roller cutter is directly welded on the bottom ring, thus it is difficult to replace the roller cutter.

SUMMARY

An object of the present invention is to provide a hard-rock core barrel roller cutter assembly, wherein a roller cutter and a saddle thereof can be quickly assembled and detached under a condition of ensuring a connecting strength thereof to satisfy the use requirements, to solve the problems of the conventional technology.

To achieve the object, the present invention provides a hard-rock core barrel roller cutter assembly, which comprises a roller cutter and a saddle. The roller cutter includes a base portion for operating, and a connecting portion integrated with the base portion and detachably connected to the saddle. The connecting portion has a butted oblique plane at its one side, and the width of the connecting portion is gradually increased from one end adjacent to the base portion to another end far away from the base portion. A fixing block is detachably connected to the saddle, and the fixing block has, at its one side, a pressure slope which matches with the butted oblique plane. The width of the fixing block is gradually decreased from one end adjacent to the base portion to another end far away from the base portion, and the saddle is muff-jointed out of the connecting portion and the fixing block.

The saddle is cannular with opens at two ends thereof, a fixing plate is arranged at the outer end of the saddle far away from the base portion, the connecting portion and the fixing block are connected to the fixing plate through a fastening bolt respectively, the outer end of each fastening bolt is screwed with two nuts, and the fixing plate has, at its edge, a stopper portion which is stopped by one end of the saddle and restricts the fixing plate to move towards the base portion.

Comparing with the conventional technology, the roller cutter and the saddle of the present invention can be quickly assembled and detached, so as to improve the efficiency of the drilling operation. Simultaneously, the hard-rock core barrel roller cutter assembly has large connecting strength, and can satisfy the requirements of the drilling operation, and can be standardized.

wherein, 10: roller cutter; 11: base portion; 12: connecting portion; 13: butted oblique plane; 20: saddle; 30: fixing plate; 31: stopper portion; 40: fastening bolt; 41: first nut; 42: second nut; 50: fixing block; 51: pressure slope.

DETAILED DESCRIPTION OF PREFERRED EMBODIMENTS

The present invention will now be described more specifically with reference to Figures and following embodiments.

Figure 1:
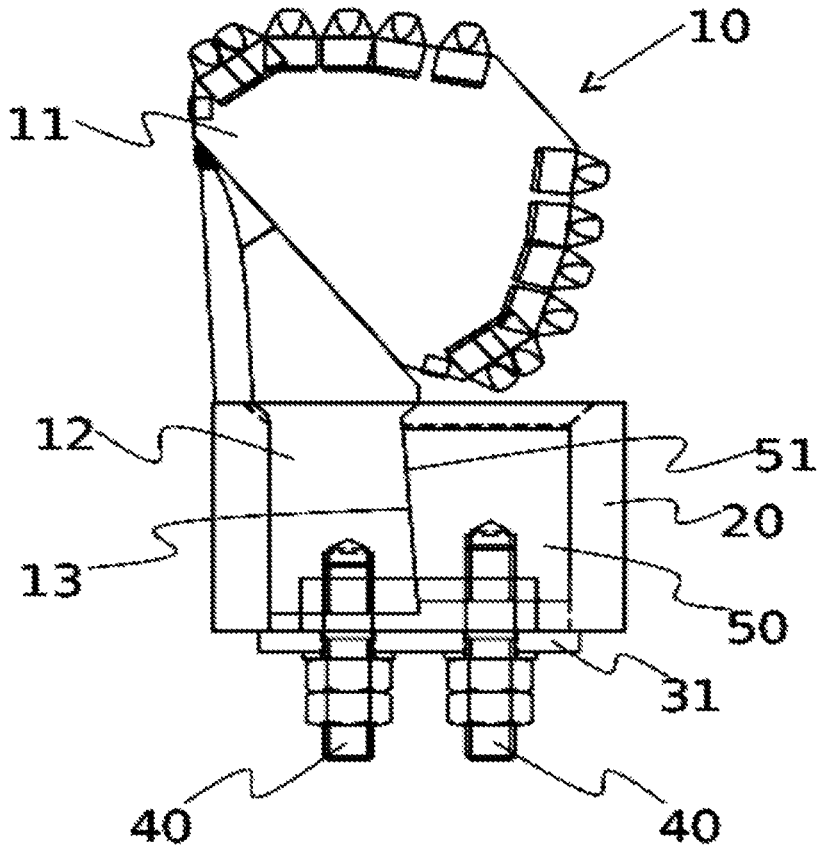
FIG. 1 is a schematic structure view of a hard-rock core barrel roller cutter assembly in accordance with an exemplary embodiment of the present invention.
Figure 2:
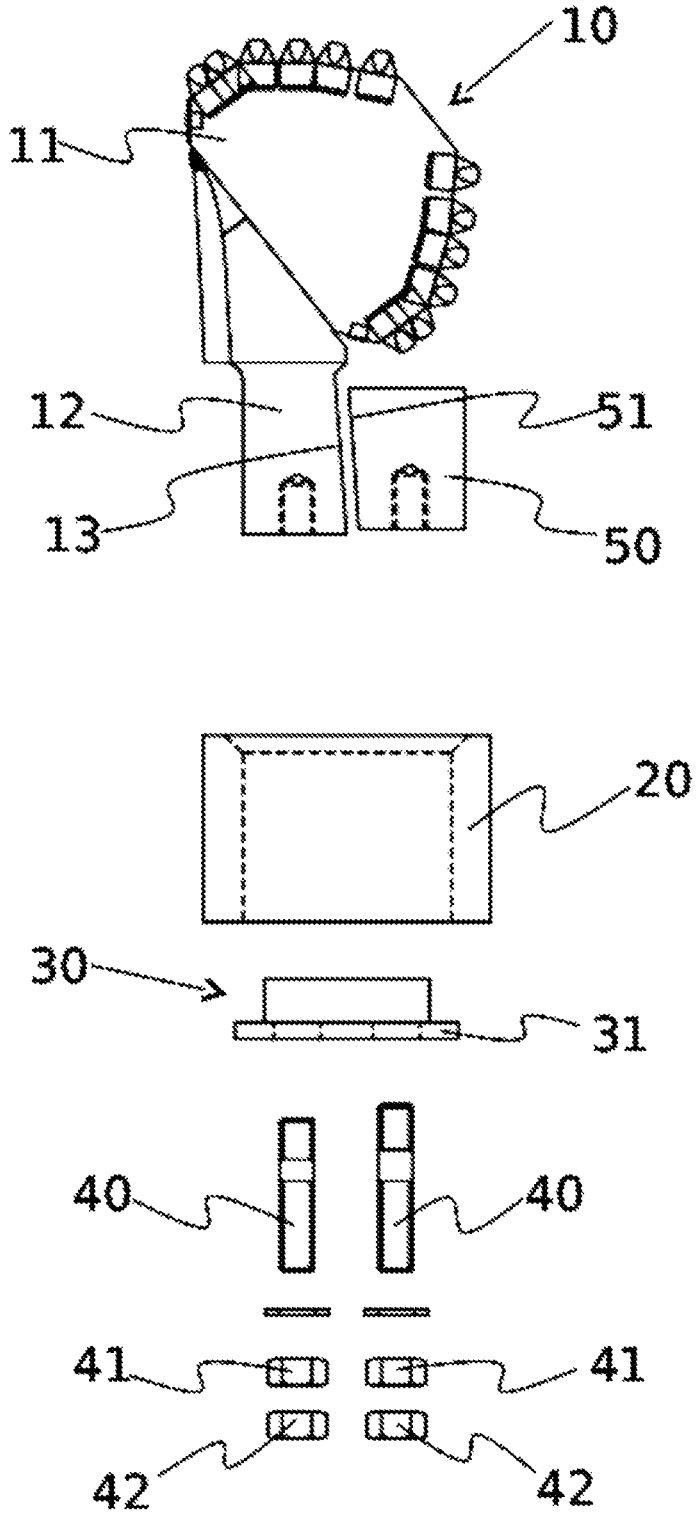
FIG. 2 is a schematic assemble view of the hard-rock core barrel roller cutter assembly in accordance with an exemplary embodiment of the present invention.

Referring to FIGS. 1, 2, a hard-rock core barrel roller cutter assembly of the present invention comprises a roller cutter 10 and a saddle 20. The roller cutter 10 has a base portion 11 configured for operating, and a connecting portion 12 integrated with the base portion 11. The connecting portion 12 has a butted oblique plane 13 at one side thereof, and the width of the connecting portion 12 is gradually increased from one end adjacent to the base portion 11 to another end far away from the base portion 11. The connecting portion 12 is detachably connected to and within the saddle 20. A fixing block 50 is also detachably connected to and within the saddle 20. A side surface of the fixing block 50 forms a pressure slope 51 that matches with the butted oblique plane 13. Furthermore, the width of the fixing block 50 is gradually decreased from one end adjacent to the base portion 11 to another end far away from the base portion 11. The saddle 20 is muff-jointed outside of the connecting portion 12 and the fixing block 50, such that the fixing block 50 can be drawn close to the connecting portion 12.

The saddle 20 of the present invention is cannular with opens at its two ends. The connecting portion 12 and the fixing block 50 are assembled from the upper opening of the saddle 20, and a fixing plate 30 is arranged at one end of the saddle 20 far away from the base portion 11. The connecting portion 12 and the fixing block 50 are connected to the fixing plate 30 through a fastening bolt 40 respectively. A first nut 41 and a second nut 42 are screwed at the outer end of the fastening bolt 40, and the second nut 42 is arranged at outer side of the first nut 41. A stopper portion 31 is formed at the periphery of the fixing plate 30, and the stopper portion 31 is stopped by the end of the saddle 20 and configured for restricting the fixing plate 30 to move to the base portion 11. When assembling, the fixing plate 30 is assembled in the lower opening of the saddle 20. When the stopper portion 31 contacts with the end of the saddle 20, the two fastening bolts 40 are inserted into the fixing plate 30 and connected to the connecting portion 12 and the fixing block 50 respectively. Then the first nut 41 is adequately screwed to lock the connecting portion 12 and the fixing block 50, and finally the second nut 42 is screwed to prevent loosening.

Because the matching of the butted oblique plane 13 and the supporting oblique plate 51 can generate a larger pressing force, the roller cutter 10 is able to be tightly fixed on the saddle 20 by adequately screwing the fastening bolt 40 when assembling. If replacing the roller cutter 10, it only needs to back out the fastening bolt 40.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A hard-rock core barrel roller cutter assembly, comprises a roller cutter and a saddle, wherein the roller cutter includes a base portion for operating, a connecting portion integrated with the base portion and detachably connected to the saddle; the connecting portion has a butted oblique plane at its one side; width of the connecting portion is gradually increased from one end adjacent to the base portion to another end far away from the base portion; a fixing block is detachably connected to the saddle; the fixing block has, at its one side, a pressure slope which matches with the butted oblique plane; width of the fixing block is gradually decreased from one end adjacent to the base portion to another end far away from the base portion; the connecting portion and the fixing block are disposed within the saddle and then are held in place; wherein the saddle is cannular with opennings at two ends thereof; a fixing plate is arranged at one end of the saddle far away from the base portion, the connecting portion and the fixing block are connected to the fixing plate through a fastening bolt respectively; an outer end of each fastening bolt is screwed with two nuts, and the fixing plate has, at its periphery, a stopper portion which is stopped by an end of the saddle and restricts the fixing plate to move towards the base portion.

* * * * *